US005245317A

United States Patent [19]

Chidley et al.

[11] Patent Number: 5,245,317

[45] Date of Patent: Sep. 14, 1993

[54] ARTICLE THEFT DETECTION APPARATUS

[76] Inventors: Duncan Chidley, 1810 Boardwalk, Apt. #1, Wildwood, N.J. 08260; Paul J. Allen, 741 Hartman Bridge Rd., Ronks, Pa. 17572

[21] Appl. No.: 808,883

[22] Filed: Dec. 18, 1991

[51] Int. Cl.[5] ..... G08B 13/22

[52] U.S. Cl. ..... 340/571; 340/572; 367/93

[58] Field of Search ..... 340/572, 571; 367/93

[56] References Cited

U.S. PATENT DOCUMENTS

| | | | |
|---|---|---|---|
| 3,713,133 | 1/1973 | Nathans | 340/572 |
| 3,891,980 | 6/1975 | Lewis et al. | 340/572 |
| 4,274,077 | 6/1981 | Feiger | 340/426 |
| 4,296,408 | 10/1981 | Neuringer | 340/539 |
| 4,314,240 | 2/1982 | Schnug | 340/573 |
| 4,511,888 | 4/1985 | Bernhardt | 340/571 |
| 4,559,529 | 12/1985 | Bernhardt | 340/571 |
| 4,573,042 | 2/1986 | Boyd | 340/539 |
| 4,593,273 | 6/1986 | Narcisse | 340/539 |
| 4,602,357 | 7/1986 | Yang et al. | 367/93 |
| 4,665,383 | 5/1987 | Desjardins | 340/506 |
| 4,665,389 | 5/1987 | Clendening | 340/574 |
| 4,686,513 | 8/1987 | Farrar et al. | 304/572 |
| 4,777,478 | 10/1988 | Hirsch et al. | 340/573 |
| 4,800,369 | 1/1989 | Tohoyi et al. | 340/572 |
| 4,804,943 | 2/1989 | Soleimani | 340/539 |
| 4,851,815 | 7/1989 | Enkelmann | 340/571 |
| 4,868,544 | 9/1989 | Havens | 340/572 |

FOREIGN PATENT DOCUMENTS 2132804A 12/1982 United Kingdom .

*Primary Examiner*—Glen R. Swann, III

*Attorney, Agent, or Firm*—Woodcock Washburn Kurtz Mackiewicz & Norris

[57] ABSTRACT

A method and system are provided for monitoring an item within a defined area and sounding an alarm if the item is removed from the area. A transmitter and transducers emit ultrasound which substantially saturates the area to be monitored. A security tag having a detector and alarm is attached to the items to be monitored within the area. Sensing circuits may be additionally provided to determine whether a security tag is being tampered with or removed by an unauthorized person. The security tag's alarm is sounded in the event that the receiver does not detect the ultrasound indicating that the monitored item is no longer in the monitored area. Additional alarms may be provided for indicating that the security tag has been tampered with or removed.

22 Claims, 6 Drawing Sheets

ARTICLE THEFT DETECTION APPARATUS

FIELD OF THE INVENTION

The invention relates generally to a method and system for monitoring the location of items. More particularly, the present invention relates to an ultrasonic alarm system for monitoring the location of an item attached to a self-powered security tag.

BACKGROUND OF THE INVENTION

The increase in theft and related crimes has created the need for more effective means of surveillance. In the past, surveillance systems attached an electromagnetic device to an item to be monitored and placed sensors at the boundaries of the area of interest (i.e., typically at the exits of a store). In the event of an unauthorized taking, the sensors would be triggered by the electromagnetic device and an alarm would sound in the monitored area. However, such devices failed to cover the area of interest surrounding the item and, thus, did nothing to inhibit the completion of the unauthorized action. For example, once an unauthorized person exited a store with a monitored item, the alarm would sound at the exit of the store. However, the person could escape, for instance, in a crowd unnoticed. Furthermore, if the electromagnetic device was removed or broken within the store, the item could be removed from the store without triggering the alarm at all. Moreover, other articles carried by customers had a tendency to trigger the sensors, thereby sounding the alarm unnecessarily.

To remedy these unwanted circumstances, subsequent systems have provided self-powered, releasably attachable alarm devices producing an alarm at the exact location of the unauthorized taking (i.e., anywhere in the store, not just exits). Such devices are triggered by placing an antenna within the alarm device and using radiated energy to signal the alarm device when an unauthorized taking is in progress. One problem facing these later systems has been the control of the radiated energy. These systems have used radio waves at various frequency levels to signal the alarm devices. However, these signals are very difficult to control in the environment in which they are intended to be used, e.g., a retail clothing store.

Therefore, later systems have used a plurality of signals to define the area to be monitored. The use of various signals requires the use of multiple transmitters which, in turn, requires that the display, checkout, fitting, and exit areas be provided with transmitters radiating different frequencies. Such complex systems not only detract from a user's flexibility in covering the monitored area, but also require more power to operate.

Such complex signal generation also forces the alarm device to be more complex in design to discern the type of energy being received at any given moment. Complex alarm devices not only use more power, but require more maintenance.

It is, therefore, desirable to provide a system which simply, but accurately, defines an area to be monitored so that an alarm may be triggered from the item itself.

SUMMARY OF THE INVENTION

The present invention provides a method and an alarm system for sounding an alarm when an item is removed from a monitored area. The system comprises an ultrasound transmitter, a receiver for detecting the ultrasound and an alarm which is operative when the ultrasound is no longer detected by the receiver. A security tag is attached to the item to be monitored wherein the security tag comprises the receiver, the alarm, and control logic. In a preferred embodiment, the security tag is attached to the monitored item via an attachment means comprising a connector and sensing means. The sensing means, preferably, detects whether the security tag is being damaged (i.e., in an effort to destroy it or render it inoperative) or whether it is being tampered with (i.e., in an effort to remove it). In a further preferred embodiment, stationary detectors are mounted in the monitoring area and can detect a signal or a variation in the alarm which depends upon whether the ultrasound is no longer detected (i.e., indicating the monitored item has been stolen), or the security tag has been broken or removed by an unauthorized person. The stationary detectors are preferably operable to initiate additional alarms.

In an additional preferred embodiment, the transmitter is coupled to a plurality of transducers. The transducers are arranged within the area to be monitored so that the entire area is substantially saturated with ultra-sound. The transmitter/transducer configuration comprises phase and gain controls so that beats, reflections and cancellation of the sound waves can be utilized to define the monitored area.

In another preferred embodiment, the ultrasound may be modulated to provide a signal that disables the receiver and/or the alarm from sounding when the ultrasound is not detected by the receiver. Such an embodiment is advantageous in that the transmitter may be shut off at desirable times (e.g., overnight) but the sensing circuits may remain operable. A decoupler may also be added to provide a signal to deactivate the sensing means so that it may be removed without sounding the alarm.

BRIEF DESCRIPTION OF THE DRAWINGS

The present invention will be better understood, and its numerous objects and advantages will become apparent by reference to the following detailed description of the invention when taken in conjunction with the following drawings, in which.

FIGS. *7a* and *7b* is a flow diagram of the control logic implementing a method of the present invention.

DETAILED DESCRIPTION OF THE INVENTION

Figure 1:
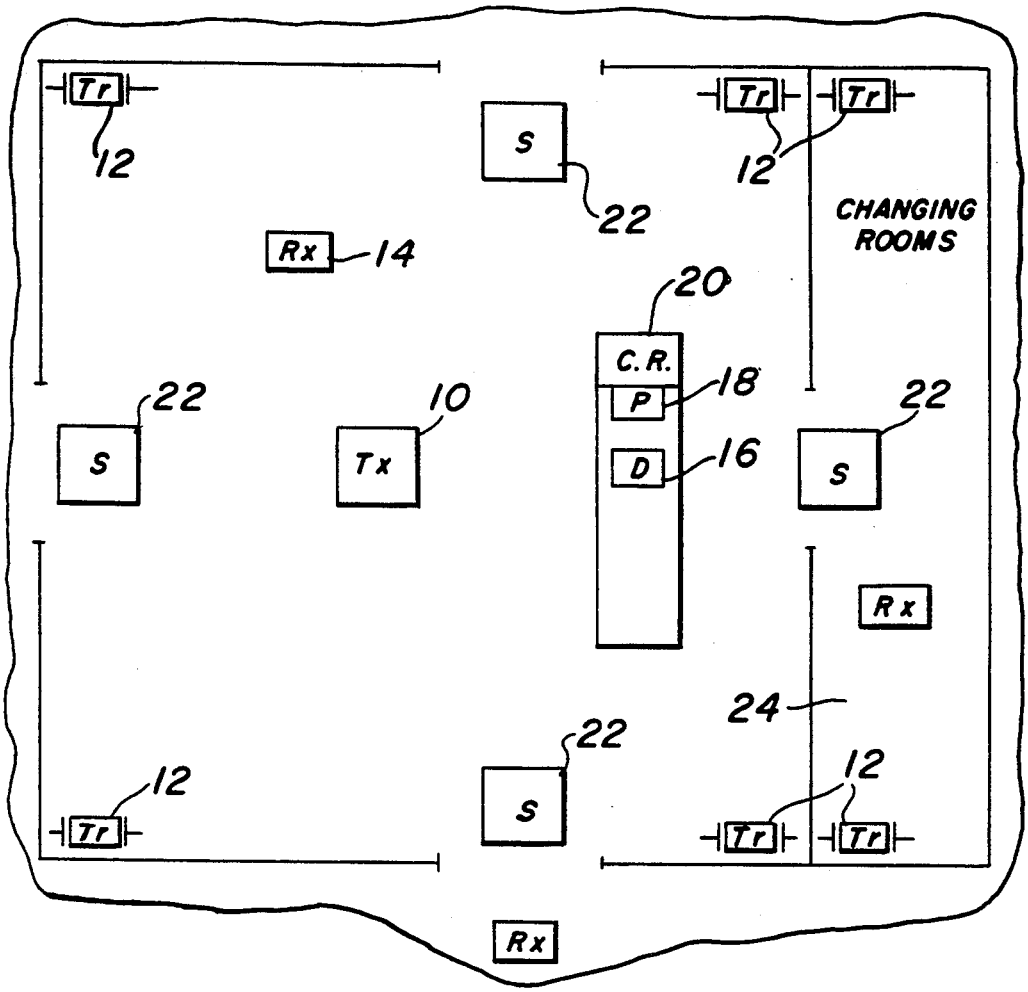
FIG. 1 is a block diagram representing a typical implementation of the system in accordance with the present invention.

Referring now to the drawings, wherein like reference numerals represent like elements in the Figures throughout, there is shown in FIG. 1 one implementation of the present invention. It should be noted, however, that the implementation shown in FIG. 1, represents only one use of the present invention; that being a security device used in retail sales environment. It should be readily understood that the present invention could similarly be used, for instance, by parents to monitor the whereabouts of their children or to monitor the location of other valuable items, or even to monitor items in transit to the area where they are to be sold, and that describing the present invention in terms of its use in the retail clothing business is purely for explanatory purposes.

Referring to FIG. 1, the present invention is shown as implemented in a typical retail clothing store. An ultrasound transmitter 10 is centrally mounted with respect to the store area in which the items of clothing are to be monitored The transmitter 10 is operatively coupled to transducers 12 which are arranged within the store to substantially saturate the store area with ultrasound. Security tags 14 comprising a receiver and an alarm will be attached to the clothing in the store. The receiver will detect the ultrasound while the security tag 14 remains within the store. However, if the security tag 14 is taken out of the saturated area, (i.e., in this case if clothing is being stolen from the store), the receiver will no longer detect the ultrasound. In such an event, the alarm will produce an audible signal which can be heard emanating from the stolen article of clothing. The security tags 14 may, in a preferred embodiment, also provide an audible alarm if the tag is tampered with by unauthorized personnel. Therefore, a decoupler 16 may also be provided to deactivate the audible alarm responsive to tampering so that authorized personnel may remove the tags 14 when appropriate. In a further preferred embodiment, a low power transmitter 18 may be located at the cash register 20, for instance, which provides a signal which can be detected by the security tag 14 causing it to sound its alarm periodically thereby reminding the checkout clerk to remove the tag before a purchaser leaves the store with the item. An additional preferred embodiment provides that stationary detectors 22 be mounted around the store. The detectors 22, detect an alarm signal from the security tags 14, and are operative to trigger additional alarms within the store such as a flashing light located outside of the dressing room 24 or the store's central security system which may be used when the store is closed.

Figure 2:
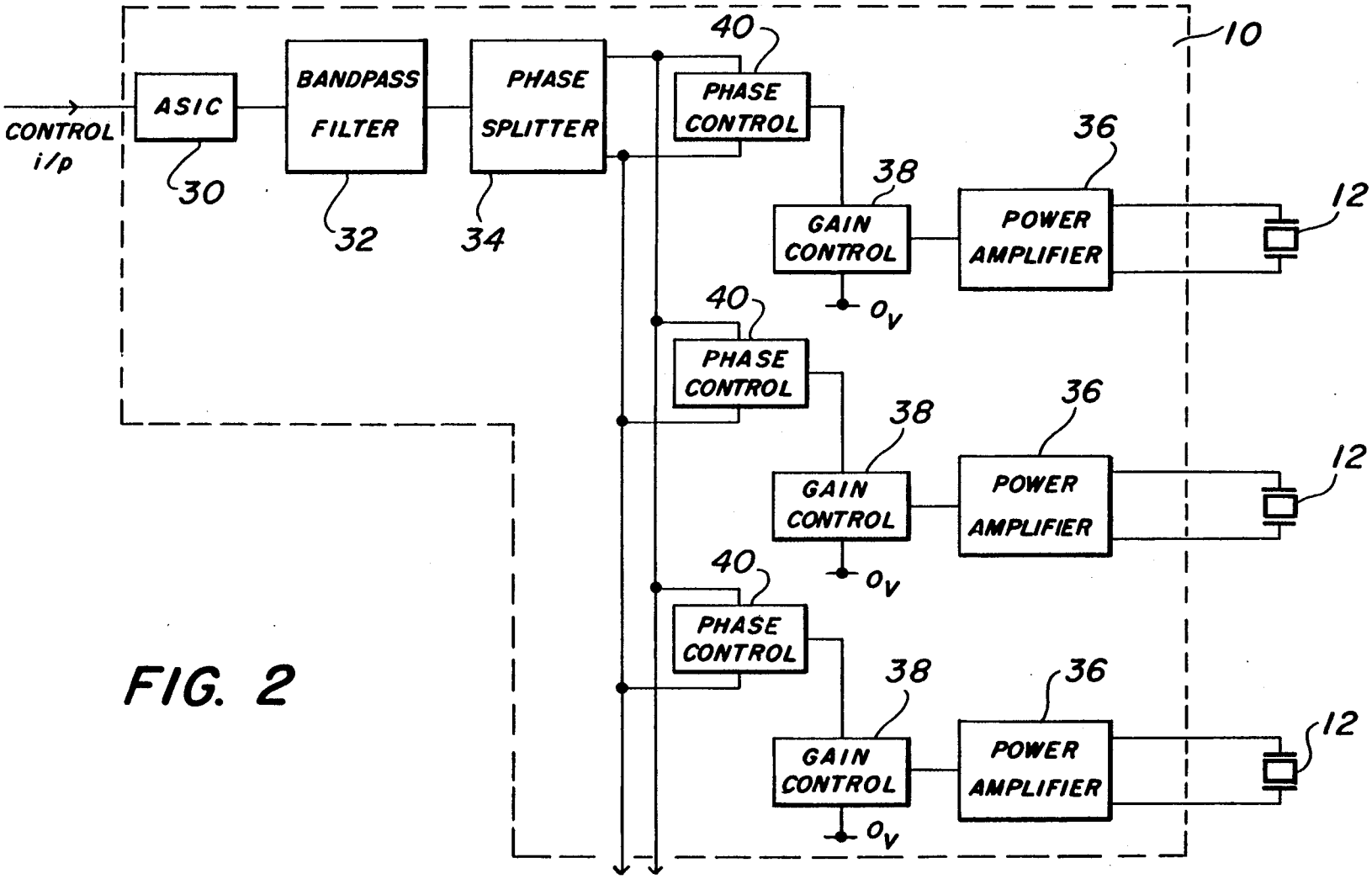
FIG. 2 is a detailed diagram of the transmitter/transducer configuration in accordance with the present invention.

FIG. 2 is a detailed diagram of the transmitter 10 and transducers 12 configuration. As described above, the area to be protected is filled with ultrasound by means of one or more ultrasonic transducer 12. The positioning of these transducers would normally be critical to the operation of the receivers due to beats, cancelling, and reflections of the ultrasound waves.

Beats occur when two signals are heard at the same time and when they have slightly different frequencies. "Beats" describe a state of continually rising and falling volume levels. Cancelling results when two signals are out of phase with each other. The negative level of one "cancels" the positive level of the other to some degree. If the signals are 180° out of phase and have the same magnitude, then one signal will substantially cancel the other. Reflections are those sound waves which bounce back from walls, ceilings and any other objects in the area.

Each transducer 12 has its own power amplifier 36, as well as variable gain control 38 and variable phase control 40. By adjusting the gain control 38 and phase control 40, reflections and cancellations can be eliminated in a manner known to those skilled in the art.

To eliminate beats the Application Specific Integrated Circuit (ASIC) 30 is used to drive these power amplification stages 36. The ASIC 30 comprises an oscillator/modulator set (not shown) to provide the necessary output, as is also well known to those skilled in the art.

The cancelling effect may, in a preferred embodiment, be used to provide a well-defined cut-off point for the ultrasound at the boundary of the protected area. For example, another power amplification stage 36 with its associated gain 38 and phase 40 controls, is used to drive a transducer 12 at the boundary to the area. If the signal is arranged such that it is 180° out of phase with the rest of the sound, and the level adjusted accordingly, the cancelling effect creates an area of "no sound".

Figure 3:
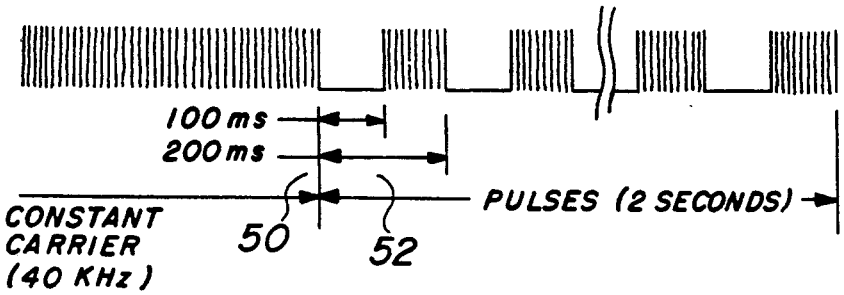
FIG. 3 depicts a signal characteristic as implemented by the present invention.

In a preferred embodiment, the transmitter 10 provides a constant unmodulated 40 kHz signal. However, this signal can be modulated, for example, to provide a pulse stream. When the pulse stream is detected by the security tag 14, the security tag 14 disables the alarm. Referring to FIG. 3, one implementation of this feature of the present invention is shown. The constant 40 kHz signal is shown generally at 50. The transmitter 10 using 100% amplitude modulation provides the signal shown at 52 characterized by a 200 ms. period with a duty cycle of 50%. The pulsed signal 52 is provided for 2 seconds. After the security tag 14 detects the pulsed signal 52, the alarm will be disabled until the constant 40 kHz signal is detected. This feature permits a substantial power savings. For instance, the transmitter may be turned off overnight, but the tags 14 may still be operative to detect tampering or removal by unauthorized personnel from the items. Additionally, the tags 14 may be installed on the items in an operative state to detect tampering with the tags 14 while in transit to the area where the items are to be monitored. When the items are brought into the area which is saturated with ultrasound, the tags are automatically activated.

Figure 4:
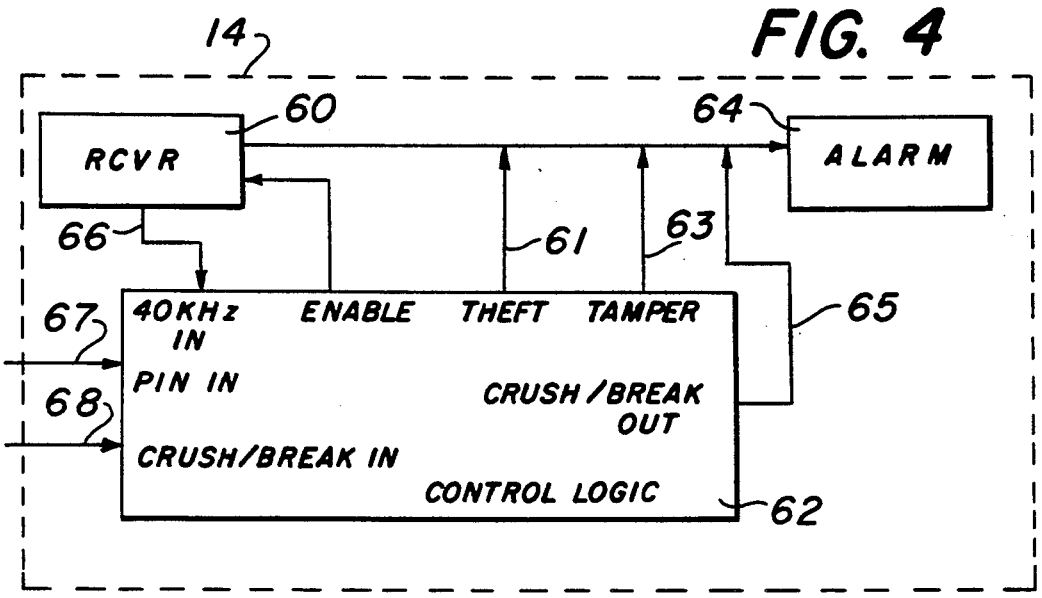
FIG. 4 is a block diagram of the security tag.

The security tag 14 is shown in greater detail in FIG. 4. As shown in FIG. 4, each security tag 14 comprises a receiver 60, control logic 62, and an audible alarm 64. The audible alarm may be provided by any commercial alarm, or may be provided by coupling together an oscillator, voltage multiplier and speaker in a manner well known to those skilled in the art.

Figure 5:
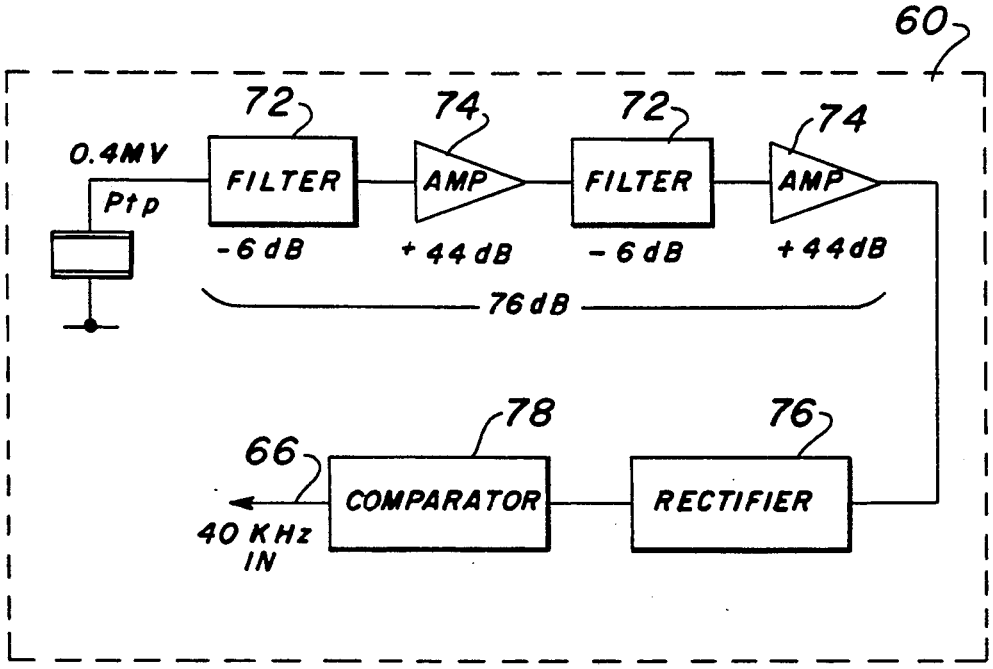
FIG. 5 is a detailed diagram of the receiver.

In a preferred embodiment, the receiver 60 has analog circuitry shown in FIG. 5. The 40 kHz ultrasound emitted from transducer 12 is detected and amplified by filters 72 and amplifiers 74. The amplified signal is then rectified into a logic level by rectifier 76. To provide a clean switching action between the two rectified levels, a comparator 78 is used. If the output of comparator 78 is high then the ultrasound has been detected. If the output of comparator 78 is low then no ultrasound has been detected. The control logic 62 provides the theft output signal 61 to the alarm 64 when the control logic receives a low signal from the receiver 60 to sound the audible alarm.

Figure 6A:
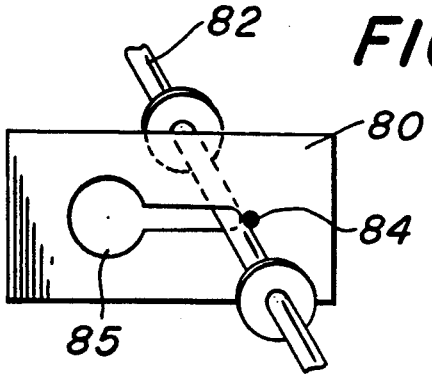
FIGS. 6A–6F show some possible examples of an attachment means according to the present invention.
Figure 6B:
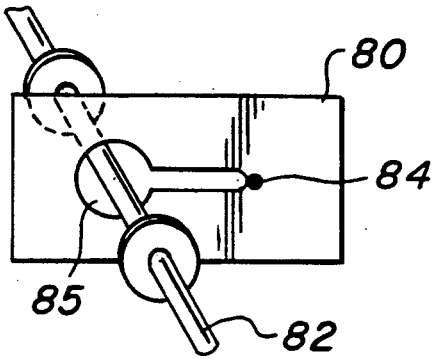

Numerous arrangements are possible for attaching a security tag to an item depending upon the intended use of the alarm system. Referring to FIGS. 6A–6F, the security tag 14 is preferably attached to an item by an attachment means 80 comprising a connector 82 and sensing means 84. The attachment means 80 shown in FIGS. 6A and 6B could be used, for instance, to attach a tag to an item of clothing. In FIGS. 6A and 6B, the attachment means 80 is represented by a plate having a slot 85, with a larger opening at one end and a narrow opening at the other end. The connector 82 is a pin shown in FIGS. 6A and 6B which can be moved within the slot to lock and unlock the attachment means 80 from a garment where FIG. 6A represents the connector 82 in a locked position and FIG. 6B represents the connector 82 in an unlocked position. Preferably, an electrical contact would be located at the edge of the narrow end of slot 85 as the sensing means 84 to detect when the attachment means 80 is attached to a garment.

Figure 6C:
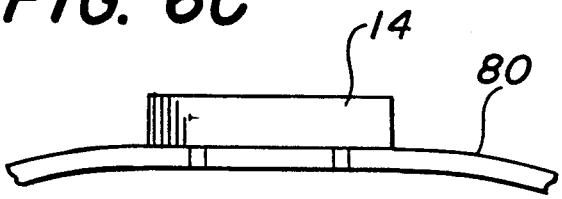
Figure 6D:
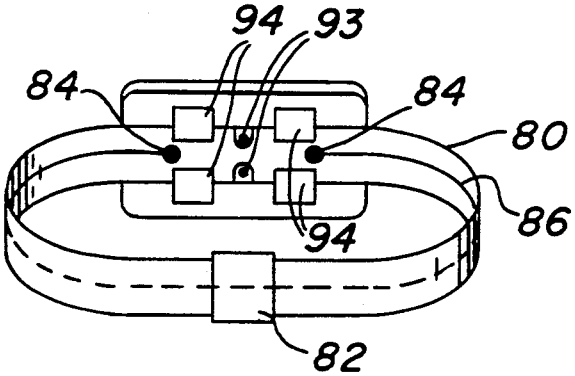

Alternatively, a wristband configuration as shown in FIGS. 6C and 6D could be used to monitor the whereabouts of a child. Security tag 14 is attached to the attachment means 80 which is the wristband by pulling it through the restraints 94 and holding it in place using posts 93. The wristband fastener is shown as connector 82. Electrical contacts act as the sensing means 84 such that when the connector 82 is fastened a wire 85 running along the attachment means 80 forms a closed circuit with the security tag 14.

Figure 6E:
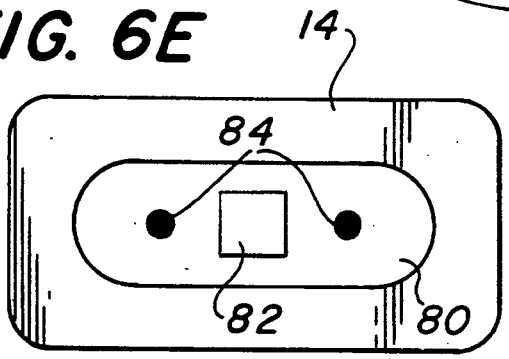

A magnetic fastener is another alternative for attaching a security tag to an item, in particular a metal item. FIG. 6E shows an attachment means 80 having a connector 82 which is a magnet. When the connector 82 is magnetically coupled to an item to be monitored, the sensing means 84 shown as electrical contacts are also coupled to the metal surface of the item to be monitored, thereby closing a circuit with the security tag which is physically connected to the security tag 14.

Figure 6F:
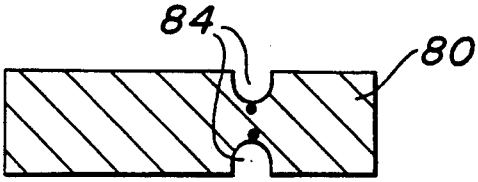
Figure 7A:
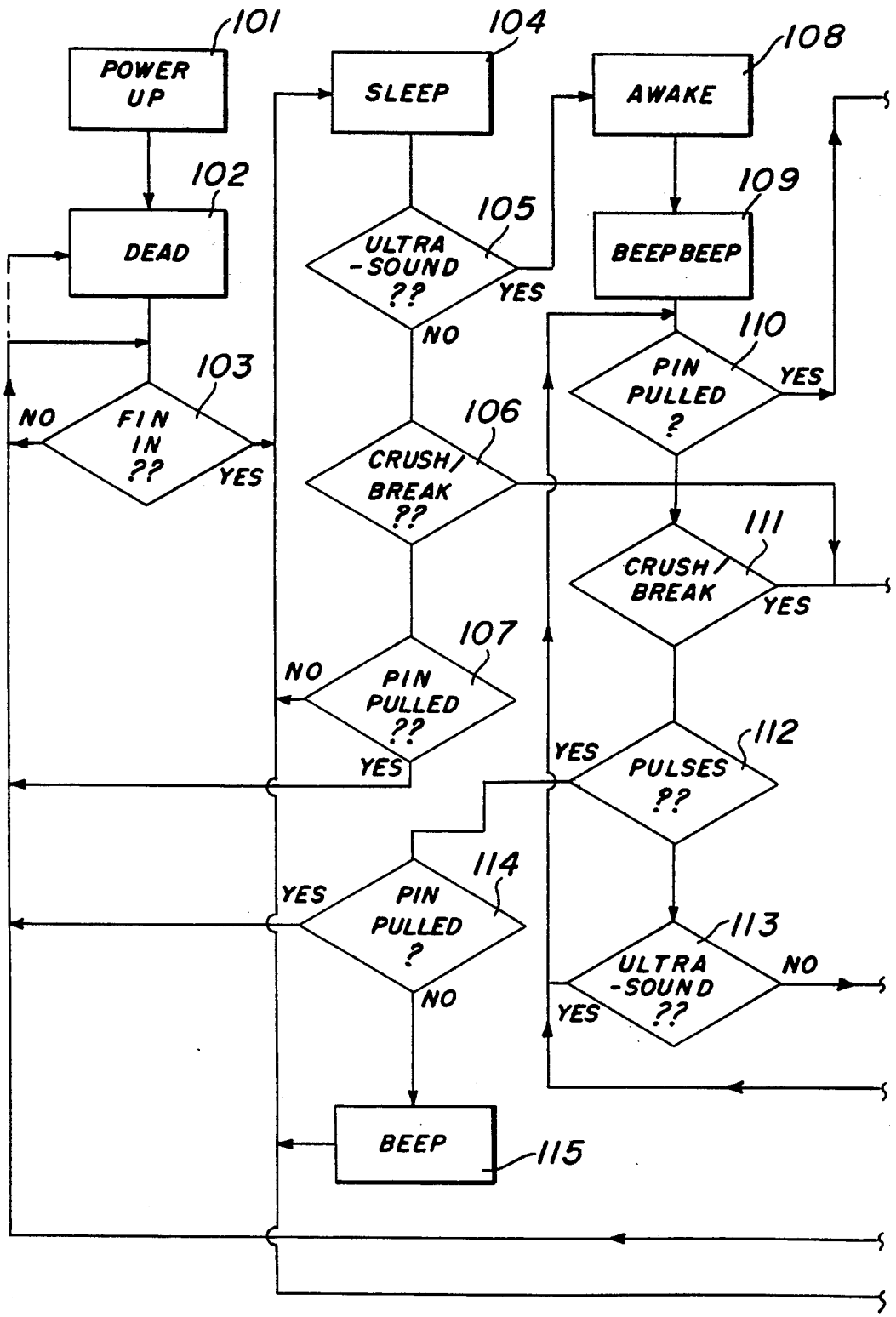
Figure 7B:
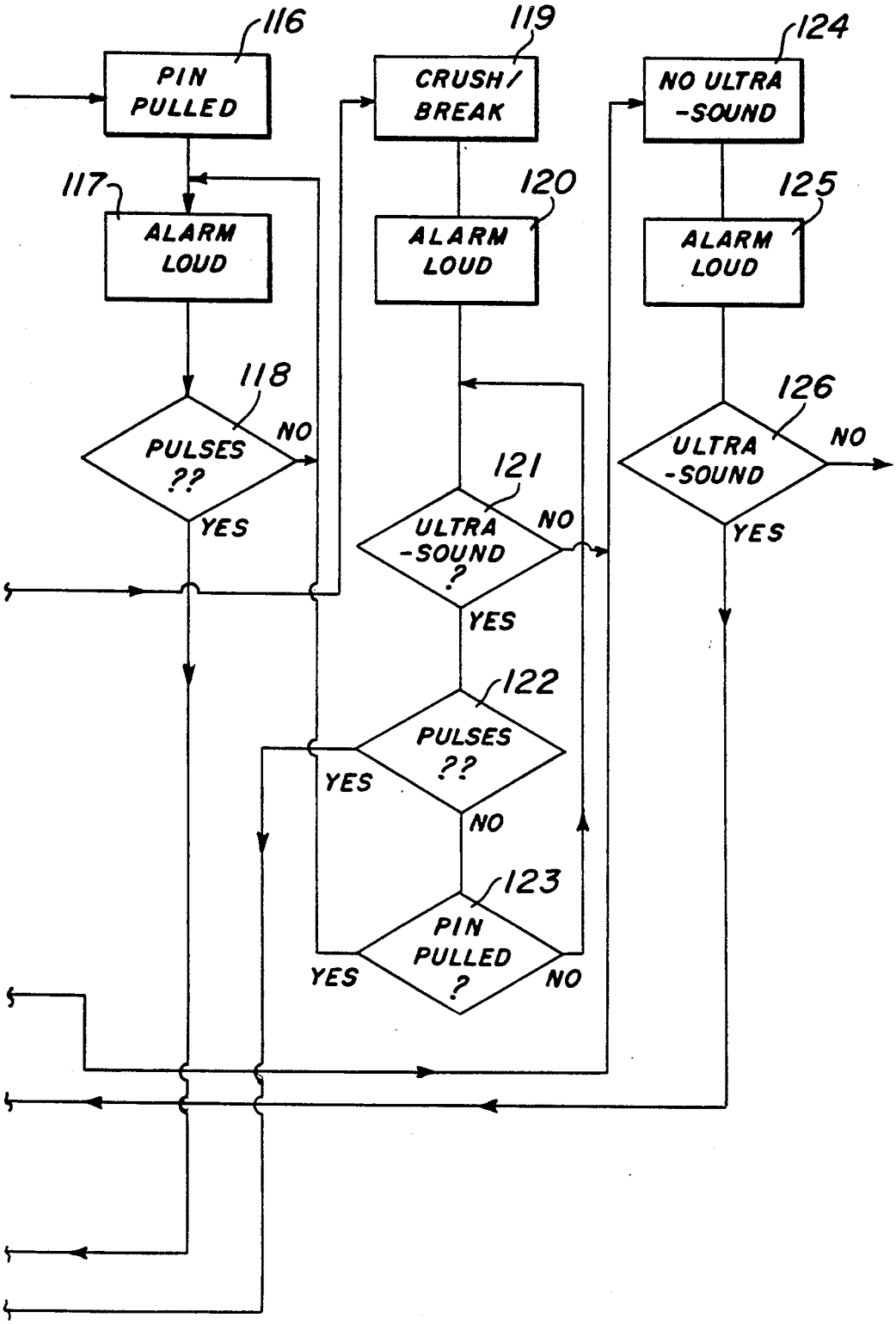

To determine if an attempt is being made to destroy the security tag, the attachment means 80 may provide two inverted domes shown as the sensing means 84 in FIG. 6F. If the domes contact one another as a result of someone trying to crush or break the security tag, the sensing means 84 will create a closed circuit with the security tag.

Although FIGS. 6A to 6F provide several examples, those skilled in the art would readily understand how to modify these arrangements to attach the security tag to an item for a particular purpose and to provide similar means for sensing whether the tag is attached and/or whether someone is attempting to destroy it.

Returning to FIG. 4, the Pin Switch In (Pin I/P) input 67 is generated by the attachment means 80. Upon attachment, the sensing means 84 sends a high, indicating an attachment is complete, i.e., closed circuit. Upon removal of the pin, the attachment means will indicate that the circuit is open via sensing means 84.

The Crush/Break input 68 is generated by the sensing means 84. The sensing means 84 detects any attempts to either break the tag 14 or forcibly detach the tag 14 from any item. For instance, the attachment means 80 may provide a low signal indicating that such attempt is being made. A high signal may alternatively indicate that no such attempt is being made.

The control logic 62 provides the outputs 61, 63, or 65 to the alarm 64 depending upon inputs 66, 67 and 68. Preferably, the alarm 64 is capable of providing a different audible alarm depending upon whether it is to be indicative of a theft, tampering or attempted destruction of the security tag 14. In such an embodiment, the detectors 22 shown in FIG. 1 would be operable to distinguish the type of audible alarm and trigger additional alarms based on whether a theft was taking place (e.g., sound an alarm at the exits of the store); whether the security tag was being removed by someone without authorization (e.g., sound an alarm in the area where the tag was removed) or whether someone is attempting to destroy the tag (e.g., flash a light in the area where it is occurring).

The low power transmitter 18 shown in FIG. 1 is a low power version of the main transmitter 10. However, it transmits pulses for 2 seconds out of every 32 seconds, the rest of the time remaining inactive. Three alarm tones will sound from the alarm 64 every time it cycles through this sequence giving an indication of the whereabouts of the security tag 14 on the protected item. The control logic 62 renders the tamper output 63 to a low state for a time after the receiver 60 detects the pulses.

FIG. *7a* and *7b* provide a flow diagram for the control logic 62. Upon "power up" at 101, the tag 14 sits in a "dead" mode at 102 whereby the receiver 60 is "looking" for nothing and is substantially disabled. To go into a "sleep" mode at 104, the attachment means 80 must be activated at 103 (i.e., pin 82 is locked into place. At this point, the control logic 62 enables the receiver 60 so that it is placed in the "sleep" mode at 104 and "listens" for ultrasound at 105. If ultrasound is now "heard" at 105, then this action produces two audible tones at 109 to provide an indication of successful activation.

If no sound is heard, then the tag 14 remains in the "sleep" mode at 104. In this mode, the logic 62 looks for a constant carrier for 2 seconds out of every 32 seconds at 105. If the carrier is heard constantly within these two seconds, then the device "wakes up" at 108 and produces the two tones at 109.

While the devices is "awake" at 108, it listens for a state of "no noise" at 113. When this state is achieved, then the control logic 62 provides theft signal 61 to sound the alarm at 124.

If "no noise" is heard for more than 0.5 seconds, then a loud alarm is sounded at 125. However, if during this time, pulses are heard, then the receiver goes into its "sleep" mode, after the pulses have ceased (not shown). If the ultrasound is "heard" at 126 while the alarm is sounding at 125, the alarm 64 is disabled and the tag 14 is returned to its "awake" mode at 108.

While pulses are being received the attachment circuit 80 may be removed without fear of the alarm sounding. Removing the pin shown at 107 invokes the "dead" mode at 102. Again, if the attachment circuit 80 is thereafter activated at 103, the receiver 60 will return to its "sleep" mode at 104.

In the "sleep" mode, or the "awake" mode, the control logic 62 is constantly looking at the pin 67 and crush/break 68 inputs at 107 and 110, and 106 and 111, respectively, sounding the alarm at 117 and 120, respectively, if either is activated. To disable the pin or crush/break alarm, pulses are transmitted to the receiver at 112 and the attachment means may be removed at 114. This will return the receiver to the "dead" mode at 102. However, the security tag 14 may be returned to the sleep mode by leaving the pin attached at 114. A single audible tone is initiated at 115 to indicate that the tag has been returned to its sleep mode at 104.

During the "sleep" and the "awake" modes the receiver periodically checks the crush/break input to determine if the tag is being vandalized. If the crush/-break output from the control logic at 106 or 111 goes to a high state, the crush/break alarm at 120 is sounded. If pulses are detected at 122, the tag is returned to its "sleep" mode at 102. However, if no pulses are detected at 122, and the tamper output from the control logic is high at 123, then the tamper alarm is sounded at 117. Again, pulses may be detected at 118 which, if the pin is removed, will return the tag to the "dead" mode at 102.

While the invention has been described and illustrated with reference to specific embodiments, those skilled in the art will recognize that modifications and variations may be made without departing from the principles of the invention as described hereinabove and set forth in the following claims.

We claim:

1. An alarm system comprising:

a variable transmitter circuit having at least one transducer for emitting inaudible sound waves, the sound waves being varied based on the configuration of an area where an item to be monitored is located and the location of each transducer to substantially saturate said area;

a security tag having a receiver and an alarm coupled to the receiver, the security tag being attachable to the item to be monitored; and the receiver being responsive to the inaudible sound waves and being operative to actuate said alarm to provide an audible signal when the receiver no longer detects the inaudible sound waves.

2. The system of claim 1, further comprising an attachment means having a connector for attaching the security tag to the item to be monitored and a sensing means for providing a signal indicative of an attempt to tamper with the security tag.

3. The system of claim 2, the security tag further comprising:

control logic operatively connected to the receiver, the alarm, and the sensing means for detecting tampering attempts when the security tag is attached to the item, the alarm being triggered by the control logic in response to the signal indicative of tampering received from the sensing means.

4. The system of claim 2, wherein the alarm provides a different audible signal depending on at least one of the following:

i) sound waves no longer detected by the receiver; and ii) detection of tampering by the sensing means, said audible signal defining an alarm signal.

5. The system of claim 4, further comprising:

an alarm detector for detecting the alarm signals from the security tag and for triggering additional alarms indicative of the alarm signal so detected.

6. The system of claim 2, further comprising:

a decoupler for transmitting a deactivating signal to the receiver, wherein the sensing means is at least temporarily disabled in response to the deactivating signal thereby permitting removal of the security tag from the item without causing the alarm to be triggered.

7. The system of claim 1, wherein the variable transmitter circuit is operative to provide a disabling signal to the receiver, the receiver inhibiting the audible alarm normally produced when the receiver no longer detects the sound waves.

8. The system of claim 1, wherein the variable transmitter circuit further comprises a plurality of transducers arranged within the area to be monitored to emit the sound waves.

9. The system of claim 1, further comprising:

a low power transmitter for providing a predetermined signal to the receiver, detection of the signal causing the audible alarm to periodically sound when the receiver is located within a defined space.

10. A method of monitoring the location of an item, comprising the steps of:

emitting inaudible sound waves, the sound waves being varied based on the configuration of an area to be monitored and the at least one location from which said sound waves are emitted to substantially saturate said area;

attaching a security tag having a receiver and an alarm coupled to the receiver to an item to be monitored wherein the receiver is operable to detect the sound waves; and triggering said alarm when the receiver does not detect the presence of the sound waves.

11. The method of claim 10, further comprising the step of:

sensing the attachment of the security tag to the monitored item thereby activating the receiver to detect the emitted sound waves.

12. The method of claim 10, further comprising the steps of:

detecting attempts by unauthorized persons to tamper with the attachment of the security tag to the item; and triggering the alarm in response to a detection of tampering with the attachment.

13. The method of claim 10, further comprising the step of:

generating a disabling signal wherein the receiver is responsive to the signal to disable the audible alarm.

14. The method of claim 12, further comprising the step of:

generating a deactivating signal wherein the receiver is responsive to the signal to inhibit at least one of i) the detection of tampering attempts and ii) the triggering of the alarm in response to the detection of tampering attempts.

15. The method of claim 12, further comprising the step of:

generating an alarm signal dependent upon at least one of i) tampering has been detected and ii) the presence of sound waves are no longer detected by the receiver; and detecting the alarm signal from the receiver at a location remote from the receiver and triggering additional alarms indicative of the alarm signal so detected.

16. An alarm system comprising:

a variable transmitter circuit for emitting inaudible sound waves;

a plurality of transducers coupled to the variable transmitter circuit and arranged within a predefined area to emit the sound waves, said variable transmitter circuit controlling the sound waves so emitted from the plurality of transducers to substantially minimize beats, cancellations, and reflections of the emitted sound waves within said predefined area;

a receiver attachable to an item to be monitored; and an alarm coupled to the receiver, the receiver further being operative to actuate said alarm to provide an audible signal when the receiver no longer detects the inaudible sound waves.

17. The system of claim 16, wherein the sound waves substantially saturate the predefined area.

18. The system of claim 16, further comprising:

a detector for detecting the audible signal from the alarm and for triggering additional alarms indicative of the audible signal so detected.

19. The system of claim 16, the receiver further comprising:

attachment means having a connector for attaching a security tag comprising one receiver and one alarm to the item to be monitored and a sensing means for providing a signal indicative of an attempt to tamper with the security tag; and control logic operatively connected to the receiver, the alarm, and the sensing means for detecting tampering attempts when the security tag is attached to the item, the alarm being triggered by the control logic in response to the signal indicative of tampering received from the sensing means.

20. The system of claim 16, wherein said variable transmitter circuit controls the sound waves emitted from said plurality of transducers so that said area is defined, at least in part, by cancellation of the sound waves at one or more locations.

21. The system of claim 16, wherein said variable transmitter circuit comprises a number of phase control circuits and gain control circuits, one phase control circuit and one gain control circuit being coupled to each of said plurality of transducers, said gain control circuits and phase control circuits being adjusted to control the sound waves emitted from said plurality of transducers to substantially minimize cancellations and reflections of the emitted sound waves within said predefined area.

22. The system of claim 21, wherein said variable transmitter circuit comprises a number of power amplifiers, one power amplifier being coupled to each of said plurality of transducers, each said powers amplifier being driven by a circuit having at least an oscillator and a modulator, said circuit being adjusted to control the sound waves emitted from said plurality of transducers to substantially minimize beats of the emitted sound waves within said predefined area.

* * * * *